US008180097B2

(12) United States Patent
Harms et al.

(10) Patent No.: US 8,180,097 B2
(45) Date of Patent: May 15, 2012

(54) DYNAMIC ELECTRO-ACOUSTIC TRANSDUCER AND EARPHONE

(75) Inventors: Alwin Harms, Hannover (DE); Elmar Schulze, Lehrte (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 295 days.

(21) Appl. No.: 12/470,123

(22) Filed: May 21, 2009

(65) Prior Publication Data

US 2009/0290749 A1 Nov. 26, 2009

(30) Foreign Application Priority Data

May 23, 2008 (DE) ..... 10 2008 024 816

(51) Int. Cl.
*H04R 1/00* (2006.01)

(52) U.S. Cl. ..... 381/400

(58) Field of Classification Search ..... 381/396, 381/400, 150–151

See application file for complete search history.

(56) References Cited

U.S. PATENT DOCUMENTS

| | | | | |
|---|---|---|---|---|
| 7,151,840 | B2 * | 12/2006 | Lenhard-Backhaus et al. | 381/396 |
| 7,221,773 | B2 | 5/2007 | Takahashi | |
| 2010/0183173 | A1 * | 7/2010 | Teske-Fischer et al. | 381/151 |
| 2010/0284559 | A1 * | 11/2010 | Scholz et al. | 381/374 |
| 2011/0007930 | A1 * | 1/2011 | Grell et al. | 381/380 |

FOREIGN PATENT DOCUMENTS

| | | | |
|---|---|---|---|
| DE | 3638727 | C2 | 5/1987 |
| DE | 4243308 | C2 | 6/1994 |
| DE | 19928241 | B4 | 2/2006 |
| EP | 0122559 | A2 | 10/1984 |
| EP | 0642291 | A2 | 3/1995 |
| EP | 0702501 | A2 | 3/1996 |
| EP | 0821540 | A2 | 1/1998 |
| GB | 776280 | | 5/1954 |
| WO | WO 03/011149 | A1 | 12/2003 |
| WO | WO 2004/021739 | A1 | 3/2004 |
| WO | WO 2004/049751 | A1 | 6/2004 |

* cited by examiner

*Primary Examiner* — Savitr Mulpuri

(74) *Attorney, Agent, or Firm* — Kilpatrick Townsend & Stockton LLP

(57) ABSTRACT

There is thus provided a dynamic electro-acoustic transducer having a moving coil (100) with a coil exit location (110) and a first and a second feed line (200, 300). The first and second feed lines (200, 300) have first ends (210, 310) for coupling to the coil exit location (110), an intermediate portion (250, 350) and second ends (220, 320). The intermediate portions (250, 350) of the first and second feed lines (200, 300) are substantially parallel to a tangent at the moving coil (100).

9 Claims, 1 Drawing Sheet

DYNAMIC ELECTRO-ACOUSTIC TRANSDUCER AND EARPHONE

CROSS-REFERENCE TO RELATED APPLICATIONS

This application claims priority of German Patent Application No. 102008024816.9, filed May 23, 2008, the disclosure of which is herein incorporated by reference in its entirety.

The invention concerns a dynamic electro-acoustic transducer and an earphone.

BACKGROUND

Particularly in the case of dynamic electro-acoustic transducers, a connection for the wire of the coil has to be provided.

DE 42 43 308 C2 discloses a dynamic electro-acoustic transducer having a diaphragm carrying the moving coil. The transducer also has two feed lines for the moving coil. In that arrangement the feed lines are in the form of an asymmetrical S-shaped meander. The S-shaped meanders of the feed lines are intended to serve to increase the maximum stroke.

Particularly in the case of dynamic transducers of small dimensions the known wiring arrangement of the feed line reaches its limits. For example it is not possible to guarantee the required continuous oscillation loading of the wires without the wires tearing away. In addition, upon a reduction in the size of the transducer and thus the wire deformation zone, it can happen that the low flexibility of the wires has an influence on the overall flexibility of the transducer so that the transducer for example is damped on one side more than on the other side.

SUMMARY

The object of the present invention is to provide a dynamic electro-acoustic transducer and an earphone, which have a higher level of transducer efficiency.

The object of the present invention is attained by a dynamic electro-acoustic transducer comprising a moving coil with a coil exit location. The dynamic electro-acoustic transducer further comprises a single tangent at the moving coil, a first and a second feed line each with a first end with a first portion for coupling to the coil exit location, and a second portion and a second end with a third portion. The second portions of the first and second feed lines are each substantially parallel to each other and to the single tangent at the moving coil.

Thus there is provided a dynamic electro-acoustic transducer having a moving coil with a coil exit location and a first and a second feed line. The first and second feed lines have first ends for coupling to the coil exit location, an intermediate portion and second ends. The intermediate portions of the first and second feed lines are substantially parallel to a tangent at the moving coil.

In accordance with an aspect of the invention the first and second feed lines are of such a configuration that they act at least portion-wise as a torsion bar.

In accordance with a further aspect of the present invention the intermediate portions are twisted upon a movement of the moving coil.

In accordance with still a further aspect of the present invention the first ends of the first and second feed lines move relatively little upon movement of the moving coil.

The invention also concerns an earphone with an above-described dynamic electro-acoustic transducer.

Further configurations of the invention are subject-matter of the appendant claims.

BRIEF DESCRIPTION OF THE DRAWINGS

Advantages and embodiments by way of example of the invention are described hereinafter with reference to the drawing.

DETAILED DESCRIPTION

Figure 1:
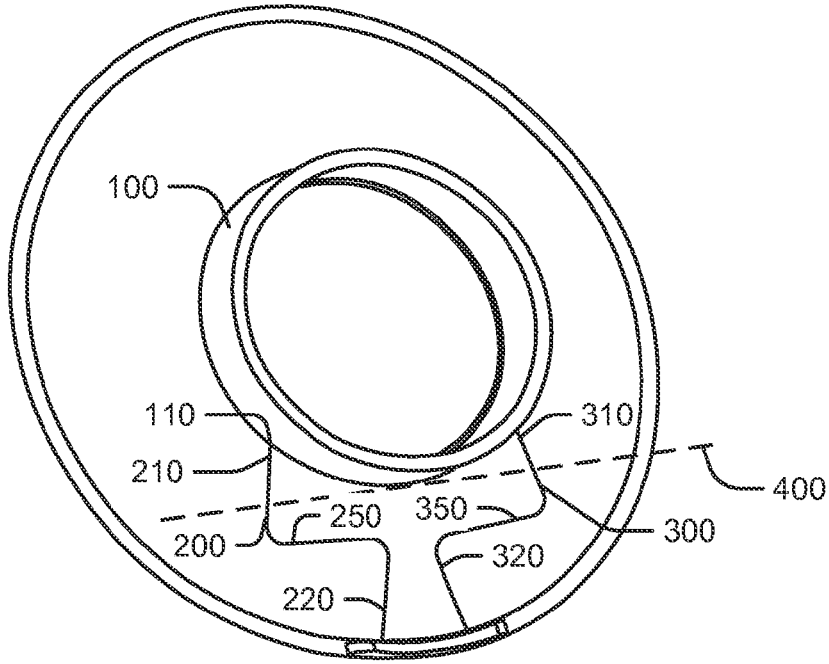
FIG. 1 shows a diagrammatic view of a dynamic electro-acoustic transducer in accordance with a first embodiment.

FIG. 1 shows a diagrammatic view of a dynamic electro-acoustic transducer in a first embodiment. The transducer has a moving coil 100 and first and second feed lines 200, 300. The feed lines are (electrically) coupled at their first end 210, 310 to the moving coil 100 and the moving coil exit location respectively and are coupled at their second end 220, 320 to a casing 400. The first ends 210, 310 of the feed lines 200, 300 can extend substantially parallel and the second ends 220, 320 of the feed lines 200, 300 are also substantially parallel. A respective intermediate portion 250, 350 is provided between the first and second ends 210, 310; 220, 320 of the feed lines 200, 300. That intermediate portion 250, 350 can optionally be at an angle of about 90° to the first and second ends 210, 310; 220, 320 of the feed lines. By virtue of that configuration of the feed line the feed line can act as a torsion bar. The consequence of this is that no bending but only a torsional movement occurs in the region of the intermediate portion when the moving coil 100 moves. In particular in that case the intermediate portions 250, 350 are twisted and move only slightly. Optionally the intermediate portions 250, 300 are substantially parallel to a tangent 400 at the moving coil 100.

Figure 2A:
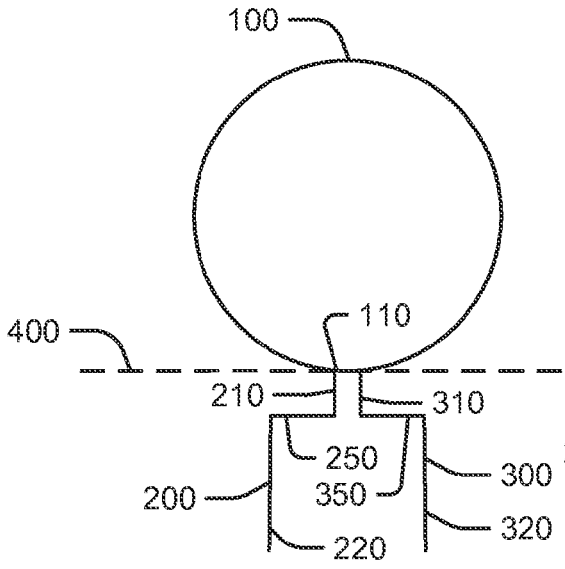
FIGS. 2A and 2B show further views of a dynamic electro-acoustic transducer in accordance with a second embodiment.
Figure 2B:
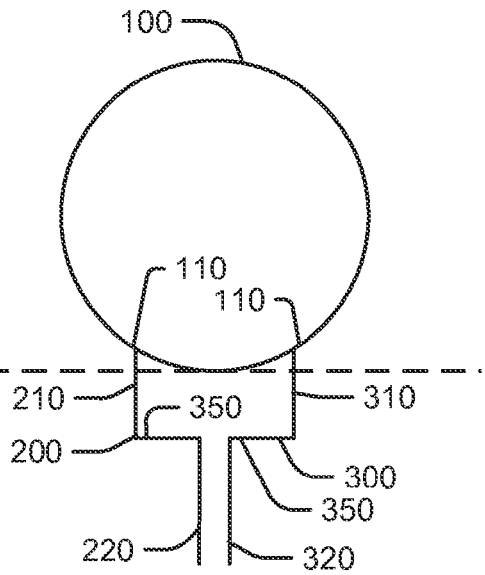
Figure 1:
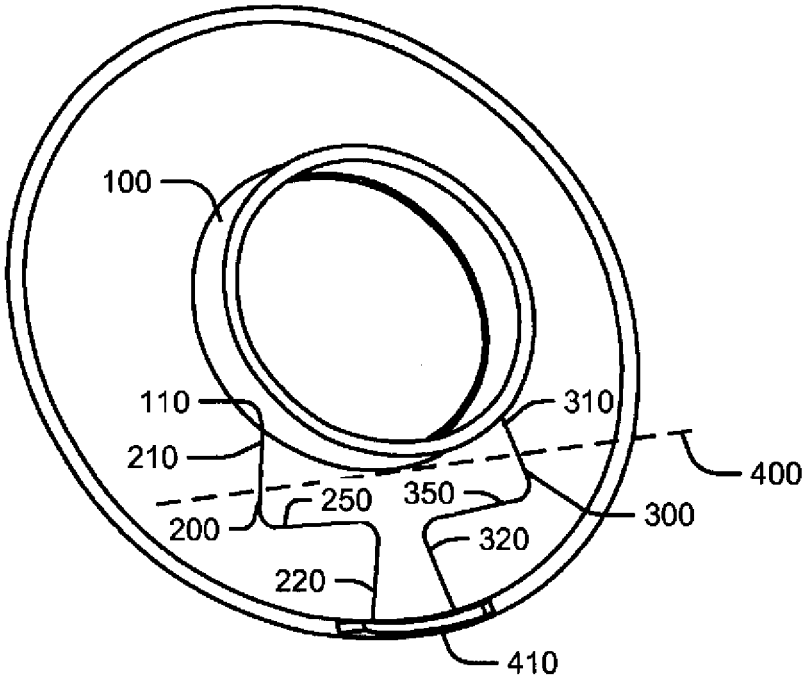
Figures 2A, 2B:
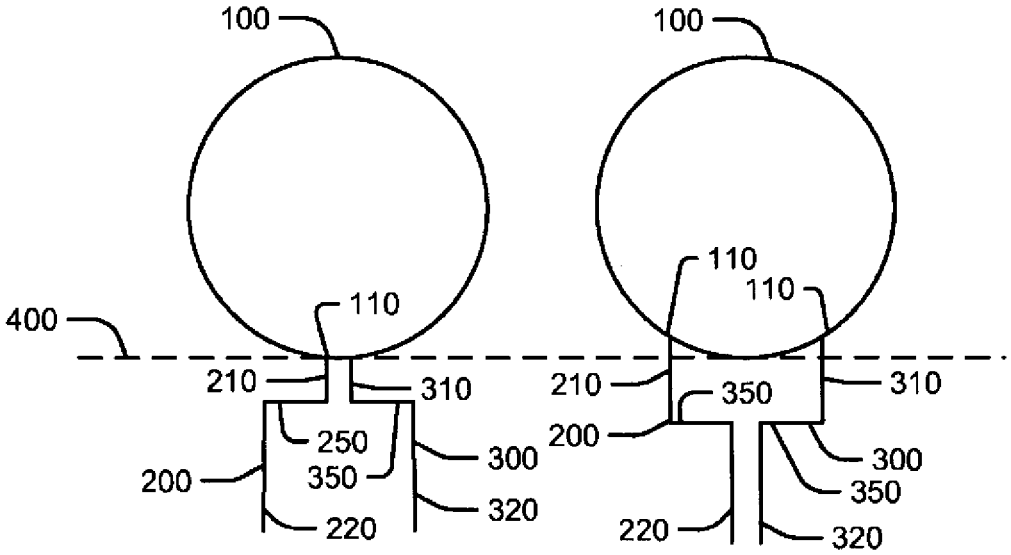

FIGS. 2A and 2B show diagrammatic views of a dynamic electro-acoustic transducer in a second embodiment. The dynamic transducer has a moving coil 100, a moving coil exit location 110 and two feed lines 200, 300. The feed lines have a first end 210, 310 coupled to the moving coil 100. The feed lines also have an intermediate portion 250, 350 and second ends 220, 320. The first ends 210, 310 and the second ends 220, 320 of the feed lines 200, 300 can be parallel to each other. The intermediate portions 250, 350 are preferably parallel to a tangent 400 at the moving coil 100. That configuration of the feed line 200, 300 can implement a torsion bar so that the intermediate portions of the feed lines are substantially only twisted but not bent.

The configuration of the feed lines in the first and second embodiments make it possible to avoid mode formation so that this now does not have any negative influence on the frequency response characteristic of the transducer. The configuration of the feed line also makes it possible to prevent the flexibility of the wires being able to influence the overall flexibility of the transducer. In addition it is possible in that way to achieve a reduction in a single-sided system damping effect.

The service life of the connecting wires of the oscillating line and thus the entire transducer is increased.

The invention concerns the concept that a maximum mechanical loading of wires in relation to a torsional stress is very much higher than in relation to a bending stress. In the transducer in the first and second embodiments an upward and downward movement of the coil provides that a part of the required mechanical deformation work occurs due to the intermediate portions or the horizontal portions of the wire due to a torsional effect in respect of those portions.

Accordingly a critical bending component at the coil exit location and the wire fixing at the outer edge of the diaphragm can be substantially reduced. To increase the length of the torsion bar (the intermediate portion) the wires can be of a suitable configuration.

In addition the wire length between the two clamping locations is increased so that the overall stiffness of the system is reduced and it is thus possible to avoid one-sided damping of the system by one of the feed lines. If the feed lines are of a sharp-edged configuration the wire modes can then be further limited.

The invention claimed is:

1. An earphone having a dynamic electro-acoustic transducer, the dynamic electro-acoustic transducer comprising:

a moving coil with a coil exit location; and a first and a second feed line with first ends for coupling to the coil exit location, an intermediate portion and second ends, wherein the intermediate portions of the first and second feed lines are substantially parallel to a tangent at the moving coil, wherein the intermediate portions are at a substantially 90 degree angle from the first and second ends, and wherein the first and second feed lines are of such a configuration that they act as a torsion bar.

2. A transducer as set forth in claim 1 wherein the intermediate portions are twisted upon a movement of the moving coil.

3. A transducer as set forth in claim 1 wherein the first ends of the first and second feed lines move relatively little upon movement of the moving coil.

4. A dynamic electro-acoustic transducer comprising:

a casing:

a moving coil with a first exit location and a second exit location;

a first feed line for coupling the first coil exit location to the casing;

a second feed line for coupling the second coil exit location to the casing, wherein the moving coil has a point equidistant between the first exit location and the second exit location, wherein the first and second feed lines are of such a configuration that they act as a torsion bar, and wherein both the first feed line and second feed line each comprise:

a first end, wherein the first end is coupled to the first exit location, and wherein the first end is substantially straight;

an intermediate portion, wherein the intermediate portion is coupled to the first end, wherein the intermediate portion is substantially straight, wherein the intermediate portion is substantially parallel to a line tangential to the point on the casing; and a second end, wherein the second end is coupled to the intermediate portion and the casing, and wherein the second end is substantially straight.

5. A transducer as set forth in claim 4, wherein the first ends of the first and second feed lines are substantially parallel to each other.

6. A transducer as set forth in claim 4, wherein the second ends of the first and second feed lines are substantially parallel to each other.

7. A transducer as set forth in claim 4, wherein the second ends of the first and second feed lines are coupled to the casing at a location equidistant from the point on the moving coil.

8. A transducer as set forth in claim 4 wherein the intermediate portions are twisted upon a movement of the moving coil.

9. A transducer as set forth in claim 4 wherein the first ends of the first and second feed lines move relatively little upon movement of the moving coil.

* * * * *

UNITED STATES PATENT AND TRADEMARK OFFICE

CERTIFICATE OF CORRECTION

PATENT NO. : 8,180,097 B2
APPLICATION NO. : 12/470123
DATED : May 15, 2012
INVENTOR(S) : Harms et al.

It is certified that error appears in the above-identified patent and that said Letters Patent is hereby corrected as shown below:

In the Abstract:

Face page, second column, the fifth line of the ABSTRACT, section (57),: please delete "an intermediate portion (250, 350)" and insert --intermediate portions (250, 350)--.

In the FIGURES, FIG. 1: Please include the number "410" and a corresponding lead line to the casing, as illustrated in the accompanying replacement sheet.

In the Specification:

In the SUMMARY, Column 1, Lines 66-67: please delete "an above-described" and insert --the above-described--.

In the BRIEF DESCRIPTION OF THE DRAWINGS, Column 2, Line 8: please delete "drawing" and insert --drawings--.

In the DETAILED DESCRIPTION, Column 2, Line 21: please delete "first end 210, 310" and insert --first ends 210, 310--.

In the DETAILED DESCRIPTION, Column 2, Line 23: please delete "second end 220, 320" and insert --second ends 220, 320--.

In the DETAILED DESCRIPTION, Column 2, Line 24: please delete "casing 400" and insert --casing 410--.

In the DETAILED DESCRIPTION, Column 2, Lines 26-27: please delete "A respective intermediate portion 250, 350 is" and insert --Respective intermediate portions 250, 350 are--.

Signed and Sealed this
Eleventh Day of September, 2012

David J. Kappos

David J. Kappos
*Director of the United States Patent and Trademark Office*

In the DETAILED DESCRIPTION, Column 2, Line 29: please delete “That intermediate portion 250, 350” and insert --The intermediate portions 250, 350--.

In the DETAILED DESCRIPTION, Column 2, Line 37: please delete “portions 250, 300” and insert --portions 250, 350--.

In the DETAILED DESCRIPTION, Column 2, Line 43: please delete “a first end 210, 310” and insert --first ends 210, 310--.

In the DETAILED DESCRIPTION, Column 2, Line 44: please delete “an intermediate portion 250, 350” and insert --intermediate portions 250, 350--.

In the DETAILED DESCRIPTION, Column 2, Line 49: please delete “feed line 200, 300” and insert --feed lines 200, 300--.